US012490825B2

(12) United States Patent
Yu

(10) Patent No.: US 12,490,825 B2
(45) Date of Patent: Dec. 9, 2025

(54) MAKEUP BRUSH HEAD

(71) Applicant: SHYA HSIN PACKAGING INDUSTRY (CHINA) CO., LTD., Kunshan (CN)

(72) Inventor: Fuhai Yu, Kunshan (CN)

( * ) Notice: Subject to any disclaimer, the term of this patent is extended or adjusted under 35 U.S.C. 154(b) by 383 days.

(21) Appl. No.: 17/866,599

(22) Filed: Jul. 18, 2022

(65) Prior Publication Data

US 2023/0270242 A1 Aug. 31, 2023

(30) Foreign Application Priority Data

Feb. 28, 2022 (CN) ..... 202220419155.9

(51) Int. Cl.

| | |
|---|---|
| ***A46B 9/02*** | (2006.01) |
| ***A45D 34/00*** | (2006.01) |
| ***A46B 1/00*** | (2006.01) |
| ***A46B 5/00*** | (2006.01) |
| ***A46B 11/00*** | (2006.01) |
| ***A46D 1/00*** | (2006.01) |

(52) U.S. Cl.

CPC ..... *A46B 9/021* (2013.01); *A45D 34/00* (2013.01); *A46B 1/00* (2013.01); *A46B 5/00* (2013.01); *A46B 9/026* (2013.01); *A46B 11/0062* (2013.01); *A46D 1/0207* (2013.01); *A46B 2200/1046* (2013.01)

(58) Field of Classification Search

CPC ..... A46B 9/021; A46B 9/02; A45D 34/00; A45D 40/26

See application file for complete search history.

(56) References Cited

U.S. PATENT DOCUMENTS

2008/0286030 A1* 11/2008 Roder ..... A45D 40/262 401/268
2014/0037364 A1* 2/2014 Hartstock ..... A46B 9/02 401/270
2019/0388201 A1* 12/2019 Chen ..... A46B 15/0071

* cited by examiner

*Primary Examiner* — Michael D Jennings
(74) *Attorney, Agent, or Firm* — Nitin Kaushik

(57) ABSTRACT

A makeup brush head includes a holding portion and an application portion fixedly connected to the holding portion. Outwardly protruding bristles are distributed on the surface of the application portion. The holding portion, the application portion, and the bristles are integrally formed into a plastic part by injection molding. The bristles are configured for applying a cosmetic material. The makeup brush head omits the flocking process, simplifies the production process, improves the production efficiency and lowers the manufacturing cost.

15 Claims, 24 Drawing Sheets

MAKEUP BRUSH HEAD

CROSS REFERENCE TO THE RELATED APPLICATIONS

This application is based upon and claims priority to Chinese Patent Application No. 202220419155.9, filed on Feb. 28, 2022, the entire contents of which are incorporated herein by reference.

TECHNICAL FIELD

The present invention relates to the field of makeup tools, and in particular to a makeup brush head for use during a makeup process.

BACKGROUND

The makeup brush is a frequently used makeup tool. Usually, it includes a handle and a brush head. Fluffs are provided on a surface of the brush head. When a user takes the brush head out of a cosmetic bottle for makeup, the user may apply cosmetic material on the fluffs to the skin. However, the prior brush head made of a flocking material has a complicated production process and tends to shed the fluffs, thus affecting the makeup effect and making the user uncomfortable.

SUMMARY

The present invention provides a makeup brush head to overcome the above defects. The holding portion, the application portion and the bristles of the makeup brush head are integrally formed by injection molding, which omits the conventional flocking process, simplifies the production process, improves the production efficiency, and lowers the manufacturing cost.

To solve the technical problems, the present invention employs the following technical solutions.

A makeup brush head includes a holding portion and an application portion fixedly connected to the holding portion. Outwardly protruding bristles are distributed on a surface of the application portion. The holding portion, the application portion and the bristles are integrally formed into a plastic part by injection molding. The bristles are configured for applying a cosmetic material.

Optionally, both the length and the diameter of each of the bristles may be in a range of 0.1-2 mm.

Optionally, the length of each of the bristles may be in a range of 0.3-0.5 mm.

Optionally, the diameter of each of the bristles may be 0.2 mm, 0.3 mm, 0.4 mm, 0.5 mm or 0.8 mm.

Optionally, the application portion may include a first end and a second end that may be arranged along a length direction of the application portion. The first end may be connected to the holding portion, and the second end may be positioned away from the holding portion. The size of the application portion from the first end to the second end may be gradually decreased.

Optionally, the bristles may be uniformly distributed on the surface of the application portion.

Optionally, the surface of the application portion may be divided into an edge region and a central region, and a bristle density of the edge region may be greater than a bristle density of the central region.

Optionally, the surface of the application portion may be divided into an edge region, a central region, and a middle region between the edge region and the central region. The bristle density of the edge region may be greater than a bristle density of the middle region, and a bristle density of the central region may be identical to the bristle density of the edge region may.

Optionally, the application portion may include a first surface and a second surface that may be positioned opposite to each other, and the bristles may be distributed on at least one of the first surface and the second surface.

Optionally, the application portion may have an arc-shaped structure. The first surface may be a convex surface, the second surface may be a concave surface, and the bristles may be distributed on both the first surface and the second surface.

Optionally, the application portion may have a conical structure. The first surface and the second surface may be arranged symmetrically along a central axis of the brush head, and the bristles may be distributed on both the first surface and the second surface.

Optionally, the application portion may be provided with at least one accommodating groove, and the accommodating groove may be configured to store the cosmetic material.

Optionally, the accommodating groove may be U-shaped or V-shaped, the accommodating groove may extend to the first surface and the second surface, and the accommodating groove may divide the first surface and the second surface into a central region and an edge region.

Optionally, the application portion may have a conical structure, the first surface may be a planar surface, and the bristles may be distributed on the first surface.

The present invention achieves the following beneficial effects: The makeup brush head is an integrally molded plastic part, that is, the bristles on the application portion, the application portion and the holding portion are molded at the same time. Compared with the conventional process of forming the brush head, the makeup brush head omits the flocking process, simplifies the production process, improves the production efficiency, and lowers the manufacturing cost. The bristles are a plastic part integrally molded with the application portion, and the lengths and diameters of the bristles are very short. As a result, there is no fluff shedding when makeup is applied, resulting in more uniform application effect and better user satisfaction. By optimizing the lengths and the diameters of the bristles, when the cosmetic material is applied, the bristles are soft and do not hurt the lip, thereby improving use experience of the product. The accommodating groove is further formed in the application portion and is configured to accommodate the cosmetic material when the brush head is put into the cosmetic bottle. In this way, the cosmetic material stored in the accommodating groove can penetrate into the bristles in use, which reduces the frequency that the user must dip the bristles into the cosmetic material, facilitates the makeup process of the user, and saves the makeup time of the user.

BRIEF DESCRIPTION OF THE DRAWINGS

FIG. 10 is a rear view according to Embodiment 3 of the present invention.

Figure 1:
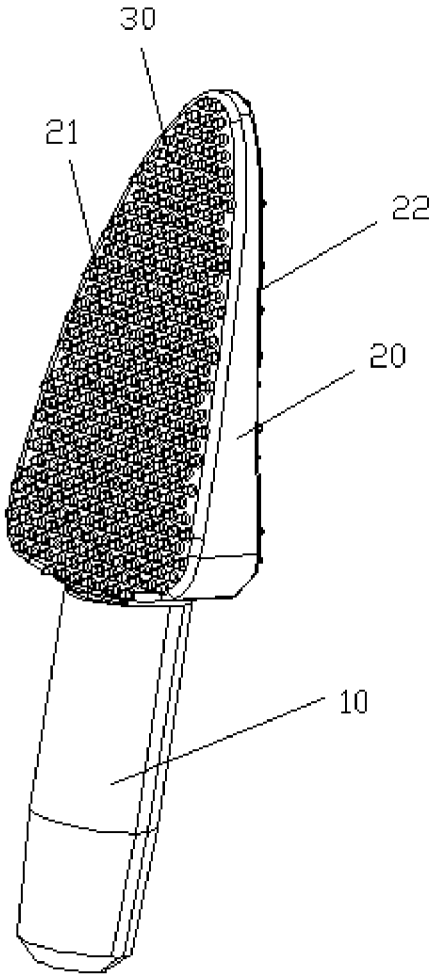
FIG. 1 is a perspective view according to Embodiment 1 of the present invention.
Figure 2:
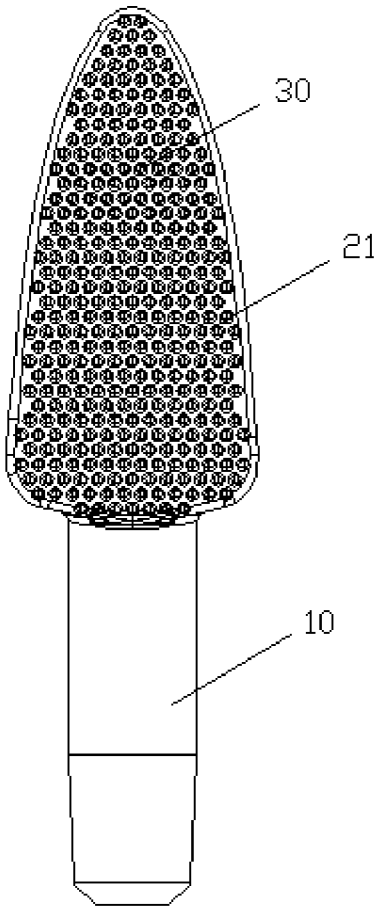
FIG. 2 is a front view according to Embodiment 1 of the present invention.
Figure 3:
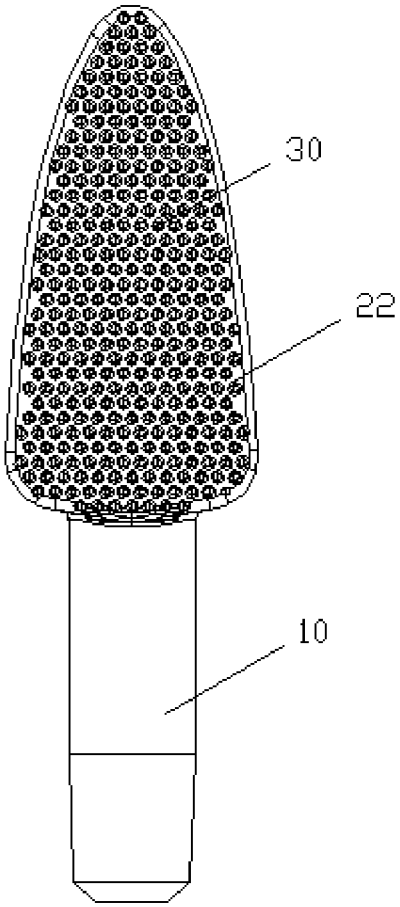
FIG. 3 is a rear view according to Embodiment 1 of the present invention.
Figure 4:
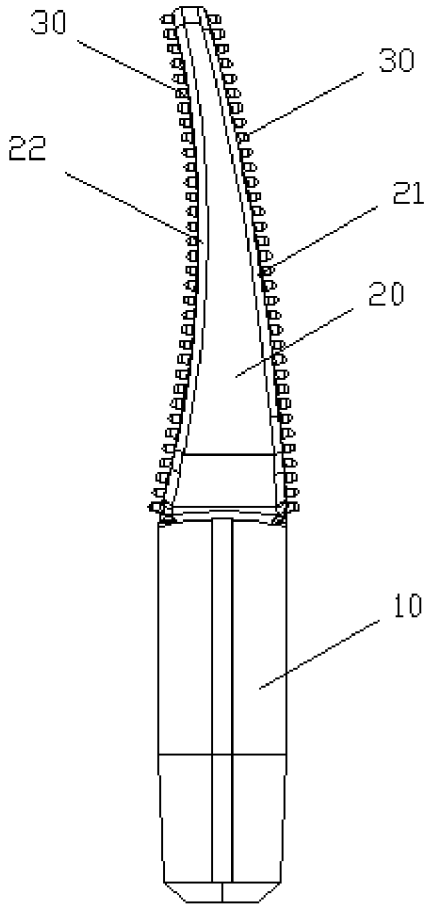
FIG. 4 is a left view according to Embodiment 1 of the present invention.
Figure 5:
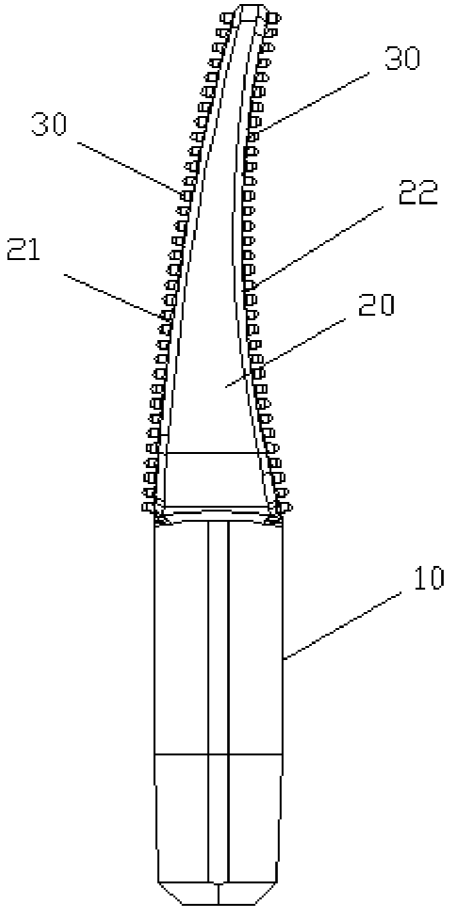
FIG. 5 is a right view according to Embodiment 1 of the present invention.
Figure 6:
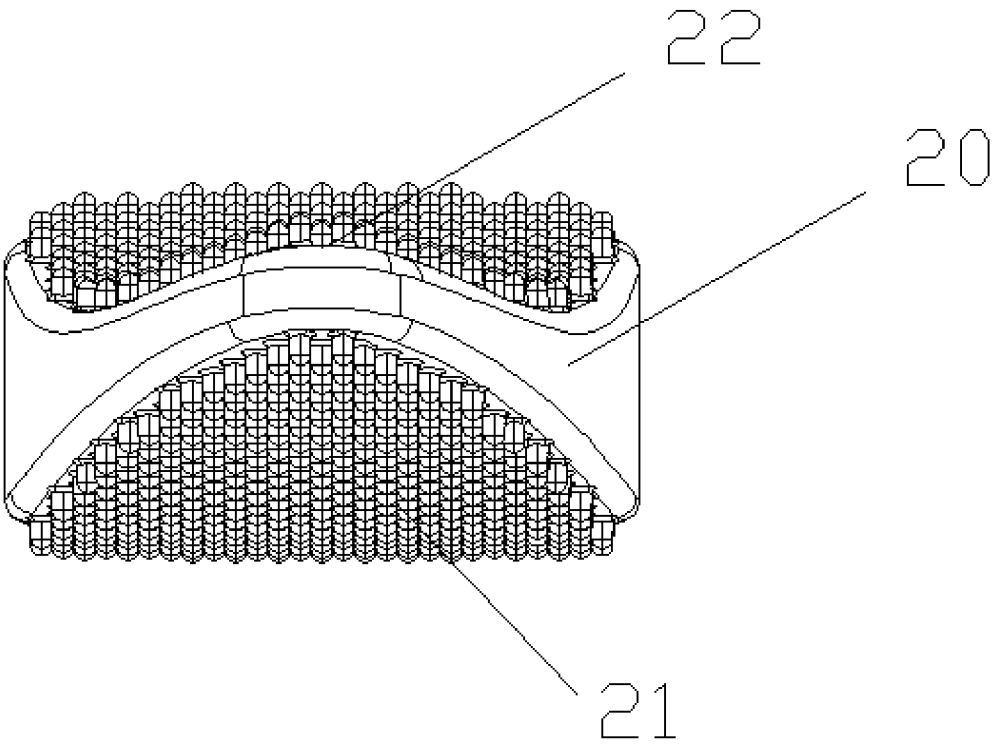
FIG. 6 is a top view according to Embodiment 1 of the present invention.
Figure 7:
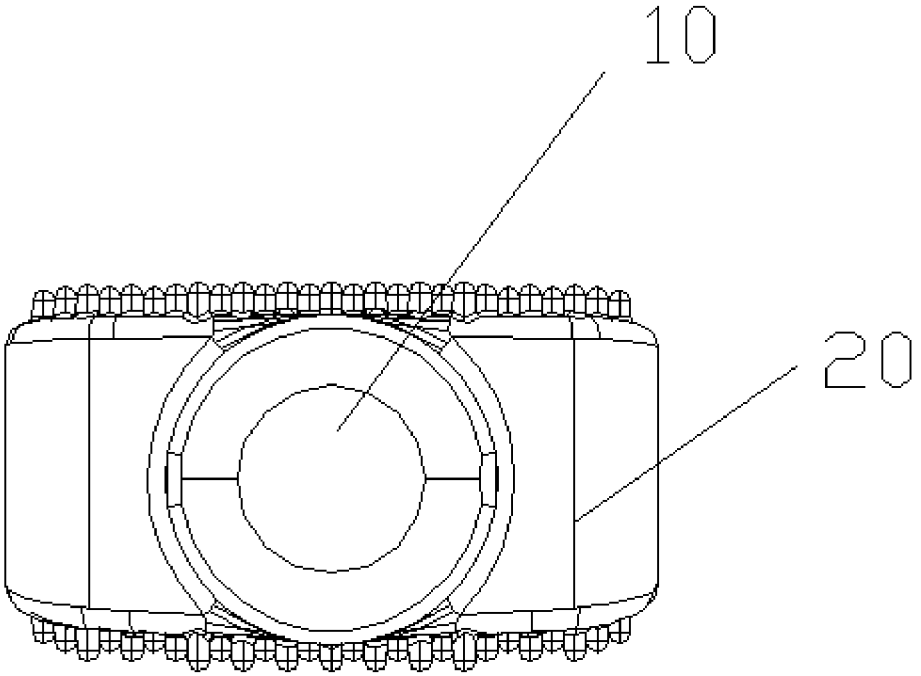
FIG. 7 is a bottom view according to Embodiment 1 of the present invention.
Figure 8:
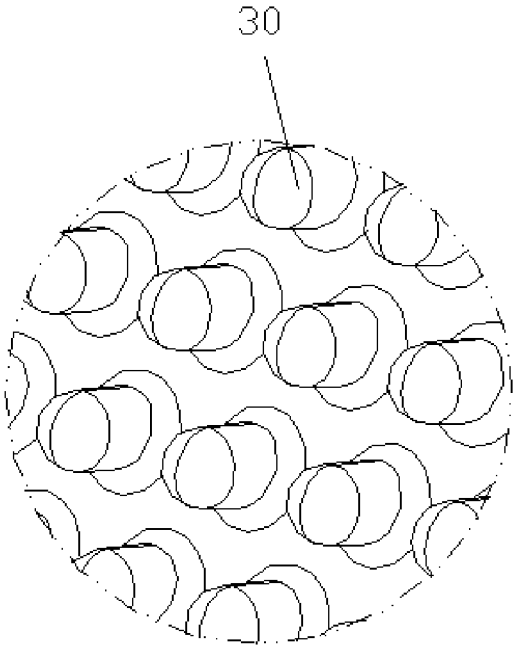
FIG. 8 is a partially enlarged view according to Embodiment 1 of the present invention.

In the figures: 10—holding portion, 20—application portion, 21—first surface, 22—second surface, 23—accommodating groove, 24—central region, 25—edge region, and 30—bristle.

DETAILED DESCRIPTION OF THE EMBODIMENTS

The technical solutions in the embodiments of the present invention are clearly and completely described below with reference to the embodiments of the present invention. It will become apparent that the described embodiments are merely some rather than all the embodiments of the present invention. All other embodiments obtained by those of ordinary skill in the art based on the embodiments of the present invention without creative efforts should fall within the protection scope of the present invention.

It should be noted that the terms "first", "second", and so on in the description and claims of this application and in the above accompanying drawings are intended to distinguish between similar objects but do not necessarily indicate a specific order or sequence. It should be understood that data used in such a way may be exchanged under proper conditions to make it possible to implement the described implementations of this application in sequences except those illustrated or described herein. Moreover, the terms "include", "contain", and any other variants mean to cover the non-exclusive inclusion, for example, a process, method, system, product, or device that includes a list of steps or units is not necessarily limited to those steps or units which are clearly listed, but may include other steps or units which are not expressly listed or inherent to such a process, method, system, product, or device.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space will be explained accordingly.

A makeup brush head includes a holding portion 10 and an application portion 20 fixedly connected to the holding portion. Outwardly protruding bristles 30 are distributed on a surface of the application portion 20. The holding portion 10, the application portion 20 and the bristles 30 are integrally formed into a plastic part by injection molding. The bristles 30 are configured for applying a cosmetic material. Optionally, both the length and the diameter of each of the bristles 30 are in a range of 0.1-2 mm. The application portion 20 includes a first end and a second end that are arranged along a length direction of the application portion. The first end is connected to the holding portion 10, and the second end is positioned away from the holding portion 10. The size of the application portion 20 from the first end to the second end is gradually decreased. The makeup brush head is an integrally molded plastic part, that is, the bristles on the application portion, the application portion and the holding portion are molded at the same time. Compared with the conventional process of forming the brush head, the makeup brush head omits the flocking process, simplifies the production process, improves the production efficiency, and lowers the manufacturing cost. The bristles are a plastic part integrally molded with the application portion, and the lengths and diameters of the bristles are very short and are in the range of 0.1-2 mm. Further, the lengths and diameters of the bristles are in the range of 0.1-1 mm. As a result, there is no fluff shedding when makeup is applied, resulting in more uniform application effect and better user satisfaction. The makeup brush head provided by the present invention can be suitable for application of skincare or makeup cosmetic materials, such as lip oil, lip gloss and lipstick.

Further, the length of each of the bristles 30 is in a range of 0.3-0.5 mm, and the diameter of each of the bristles 30 is 0.2 mm, 0.3 mm, 0.4 mm, 0.5 mm or 0.8 mm. By optimizing the lengths and the diameters of the bristles, when the cosmetic material is applied, the bristles are soft and do not hurt the lip, thereby improving use experience of the product.

In an implementation, the bristles 30 are uniformly distributed on the surface of the application portion 20, that is, the entire surface of the application portion has an identical bristle density.

In another implementation, the surface of the application portion is divided into an edge region and a central region, and a bristle density of the edge region is greater than a bristle density of the central region. The surface of the application portion is divided into two regions as needed, including the external edge region, and the central region. The area of the edge region can be adjusted flexibly according to actual needs. There are sparse bristles in the central region, and dense bristles in the edge region.

In still another implementation, the surface of the application portion is divided into an edge region, a central region, and a middle region between the edge region and the central region. A bristle density of the edge region is greater than a bristle density of the middle region, and a bristle density of the central region is identical to the bristle density of the edge region. The surface of the application portion is divided into three regions as needed, including the external edge region, the central region at the very center of the application portion, and the middle region between the edge region and the central region. There are dense bristles in the edge region and the central region, and sparse bristles in the middle region.

The application portion 20 includes a first surface 21 and a second surface 22 that are positioned opposite to each other. The bristles 30 are distributed on at least one of the first surface 21 and the second surface 22. The application portion includes two surfaces, namely the first surface and the second surface. The bristles may be distributed on both surfaces or on a single surface, that is, the bristles 30 are distributed on both the first surface and the second surface, or the bristles are distributed only on the first surface or the second surface. Detail descriptions will be made with the following three embodiments.

Embodiment 1: As shown in FIGS. 1-8, the application portion 20 has an arc-shaped structure. The first surface 21 is a convex surface. The second surface 22 is a concave surface. The bristles 30 may be distributed on both the first surface 21 and the second surface 22. In a possible implementation, the bristles 30 are distributed on both the first surface 21 and the second surface 22. Both the first surface and the second surface are of a claw shape, with the concave and convex surfaces for different use requirements.

Embodiment 2: As shown in FIGS. 9-16, the application portion 20 has a conical structure. The first surface 21 and the second surface 22 are arranged symmetrically along a central axis of the brush head. The bristles 30 may be distributed on both the first surface 21 and the second surface 22. In a possible implementation, the bristles 30 are distributed on both the first surface 21 and the second surface 22.

The application portion 20 is provided with at least one accommodating groove 23. The accommodating groove is configured to store the cosmetic material. The cosmetic material in the accommodating groove 23 is available to the bristles 30. There are no limits made on the quantity, position, and shape of the accommodating groove 23. For example, there may be one or more accommodating grooves 23. In case of multiple accommodating grooves, they may be arranged in parallel. The accommodating groove 23 may be formed at the center of the application portion, and may be circular, elliptical, square or annular. The accommodating groove is configured to accommodate the cosmetic material when the brush head is put into the cosmetic bottle. In this way, the cosmetic material stored in the accommodating groove can penetrate into the bristles in use, which reduces the frequency that the user must dip the bristles into the cosmetic material, facilitates the makeup process of the user, and saves the makeup time of the user.

Figure 9:
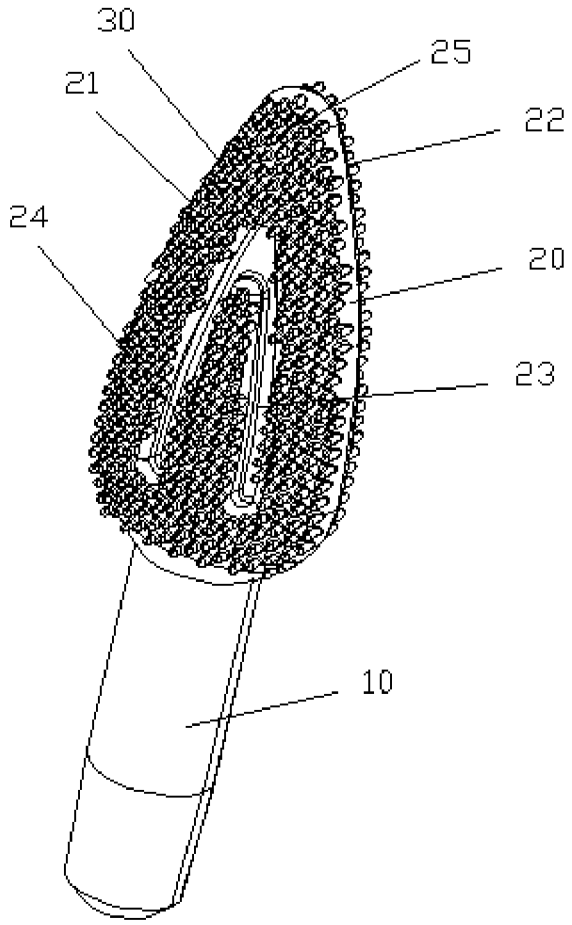
FIG. 9 is a perspective view according to Embodiment 2 of the present invention.
Figure 10:
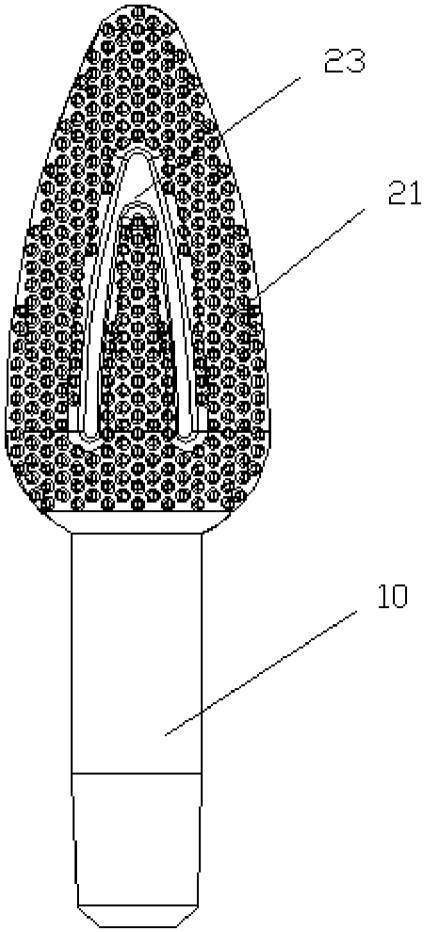
FIG. 10 is a front view according to Embodiment 2 of the present invention.
Figure 11:
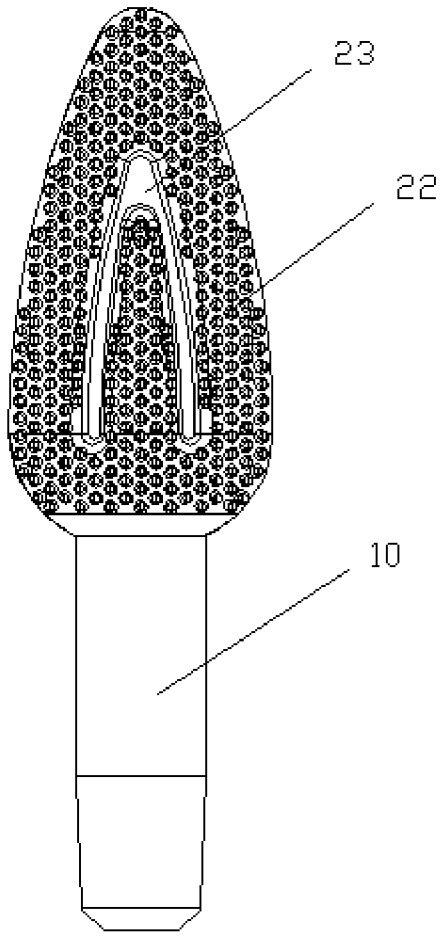
FIG. 11 is a rear view according to Embodiment 2 of the present invention.
Figure 12:
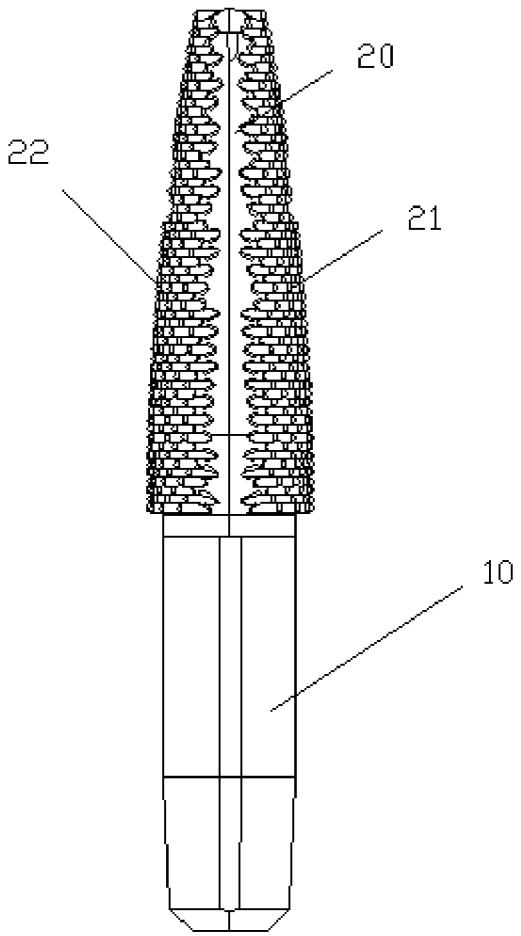
FIG. 12 is a left view according to Embodiment 2 of the present invention.
Figure 13:
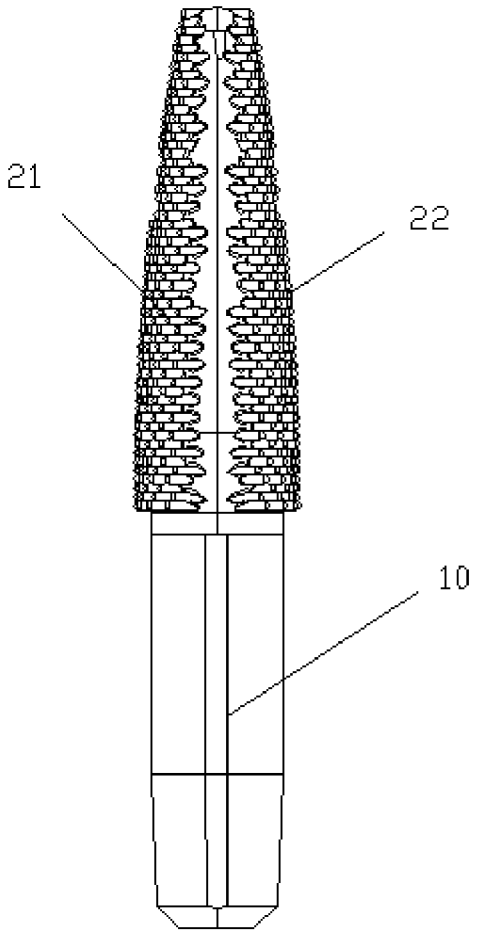
FIG. 13 is a right view according to Embodiment 2 of the present invention.
Figure 14:
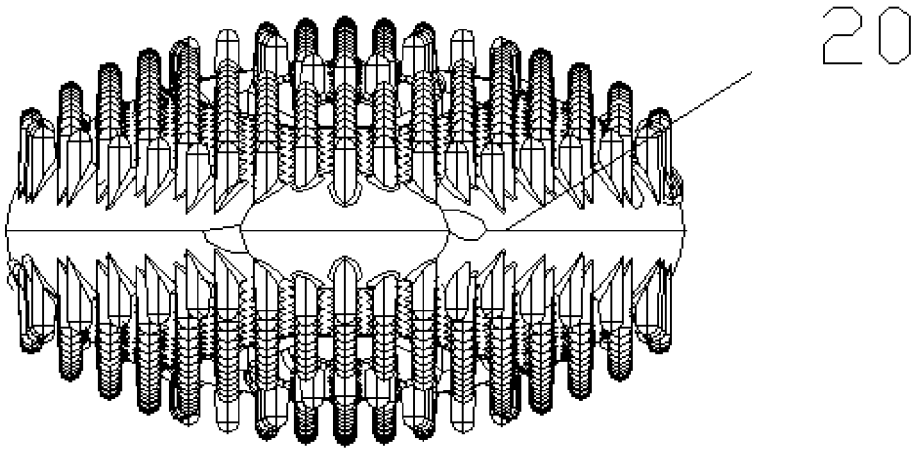
FIG. 14 is a top view according to Embodiment 2 of the present invention.
Figure 15:
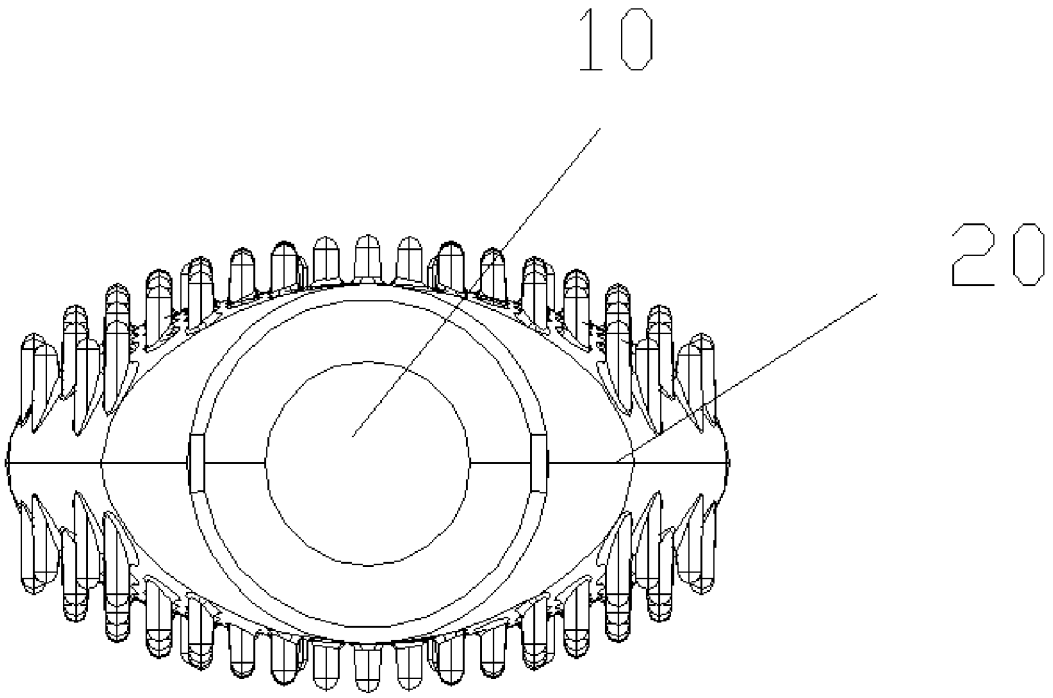
FIG. 15 is a bottom view according to Embodiment 2 of the present invention.
Figure 16:
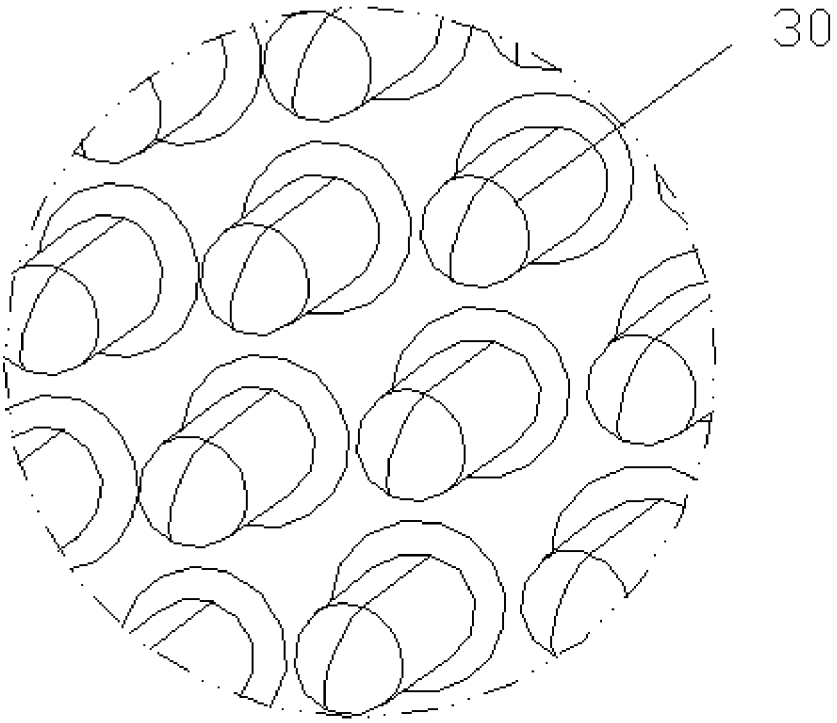
FIG. 16 is a partially enlarged view according to Embodiment 2 of the present invention.
Figure 17:
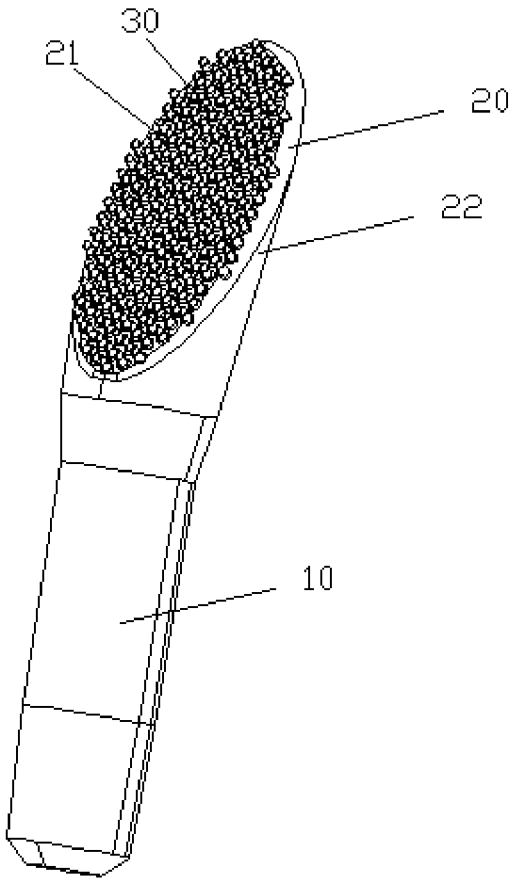
FIG. 17 is a perspective view according to Embodiment 3 of the present invention.
Figure 18:
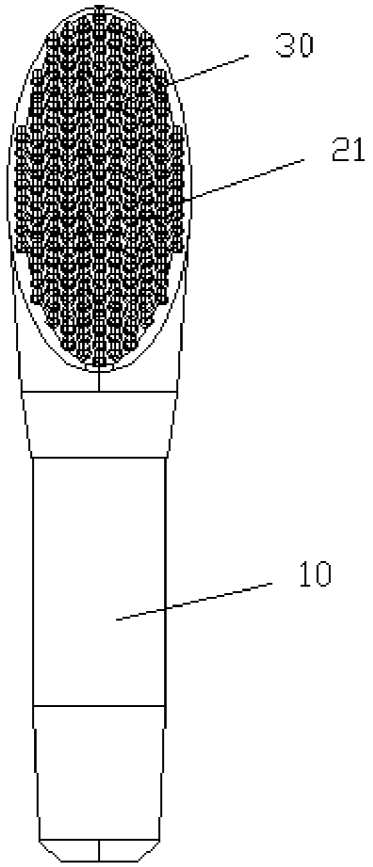
FIG. 18 is a front view according to Embodiment 3 of the present invention.
Figure 19:
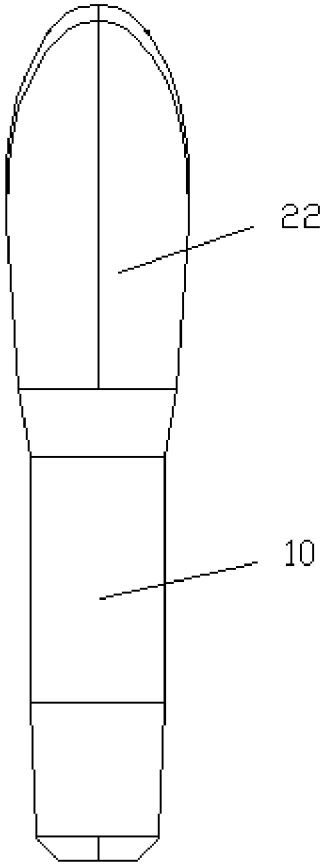

Further, as shown in FIG. 9-11, the accommodating groove 23 is U-shaped or V-shaped. The accommodating groove 23 extends to the first surface 21 and the second surface 22. The accommodating groove 23 divides the first surface 21 and the second surface 22 into a central region 24 and an edge region 25.

Figure 20:
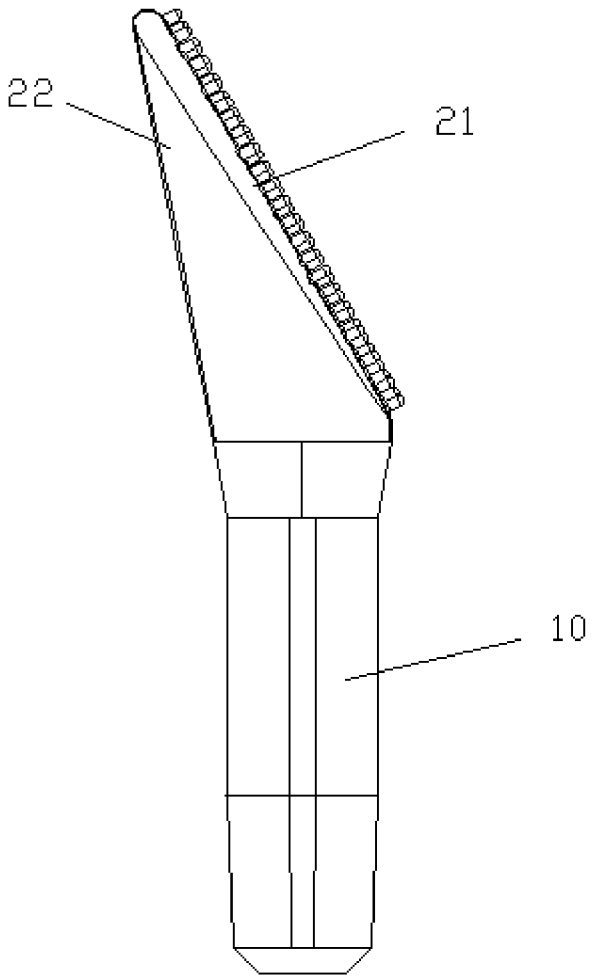
FIG. 20 is a left view according to Embodiment 3 of the present invention.
Figure 21:
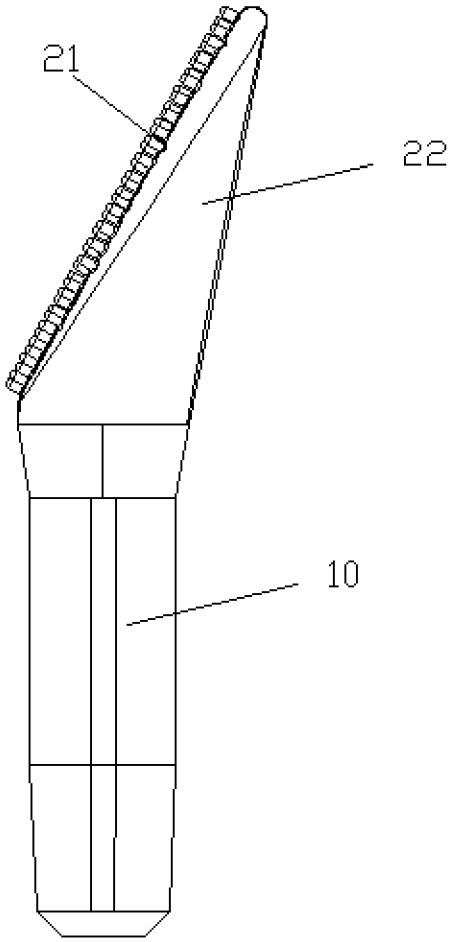
FIG. 21 is a right view according to Embodiment 3 of the present invention.
Figure 22:
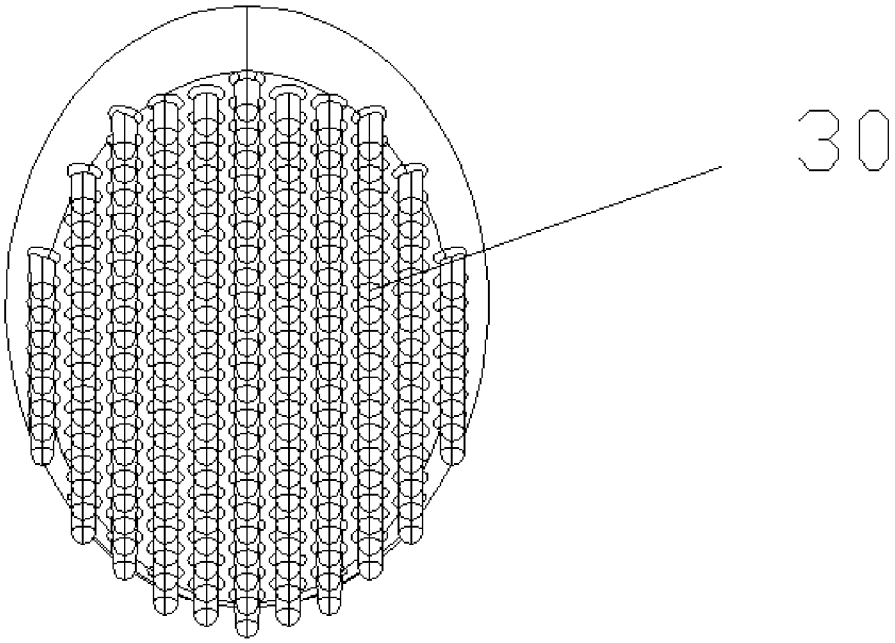
FIG. 22 is a top view according to Embodiment 3 of the present invention.
Figure 23:
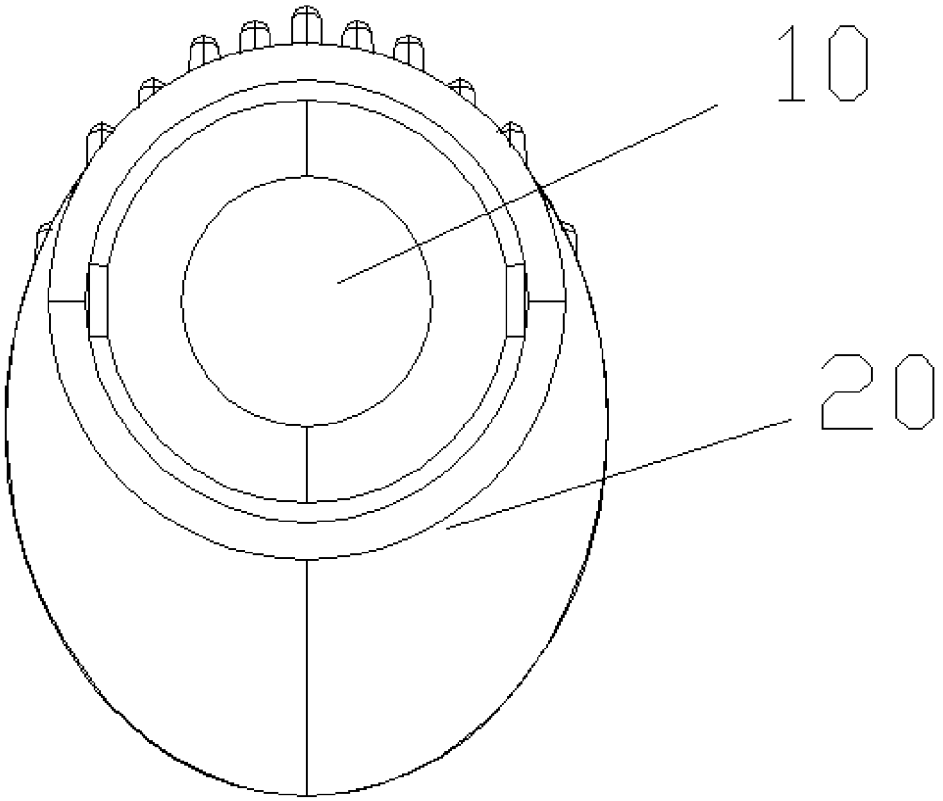
FIG. 23 is a bottom view according to Embodiment 3 of the present invention.
Figure 24:
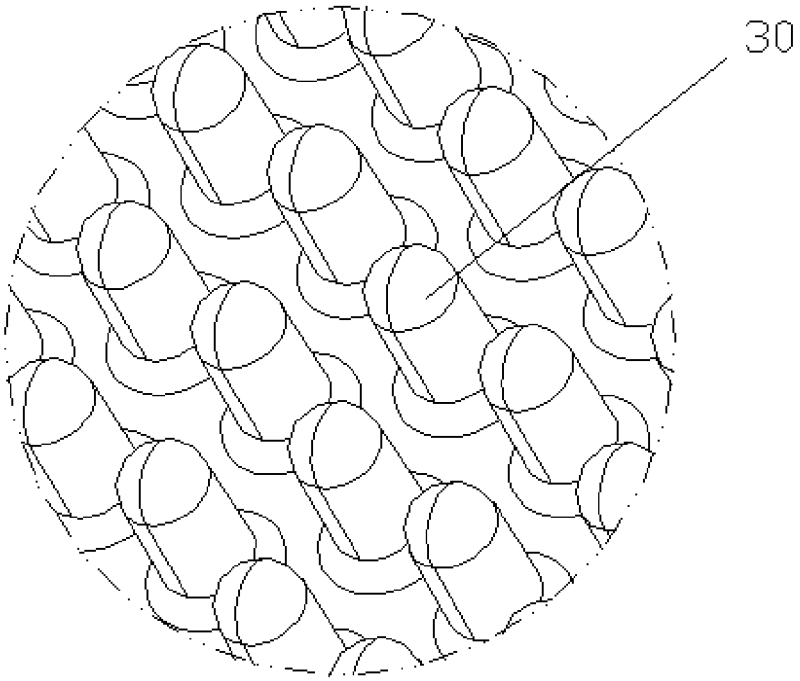
FIG. 24 is a partially enlarged view according to Embodiment 3 of the present invention.

Embodiment 3: As shown in FIGS. 17-24, the application portion 20 has a conical structure. The first surface 21 is a planar surface and the bristles 30 are distributed on the first surface 21. In a possible implementation, the bristles 30 are distributed on the first surface 21. As shown in FIGS. 20-21, from the left view or the right view, the application portion 20 is of a structure similar to a right-angled trapezoid. The first surface 21 is obliquely provided on the application portion 20. The first surface serves as an effective surface for providing the bristles 30. Except the first surface, the remaining surface of the application portion serves as the second surface. The second surface is an arc surface and a support surface, that is, there are no bristles on the second surface.

It should be noted that those of ordinary skill in the art can further make variations and improvements without departing from the concept of the present invention. These variations and improvements all fall within the protection scope of the present invention. Therefore, the protection scope of the present invention should be subject to the protection scope defined by the claims.

What is claimed is:

1. A makeup brush head, comprising a holding portion and an application portion fixedly connected to the holding portion, wherein bristles are distributed on a surface of the application portion and protrude outwardly; the holding portion, the application portion and the bristles are integrally formed into a plastic part by injection molding; and the bristles are configured for applying a cosmetic material;

wherein the application portion comprises a first surface and a second surface, wherein the first surface and the second surface are positioned opposite to each other, and the bristles are distributed on at least one of the first surface and the second surface;

wherein the application portion is provided with at least one accommodating groove, and the at least one accommodating groove is configured to store the cosmetic material;

wherein the at least one accommodating groove is U-shaped or V-shaped, the at least one accommodating groove extends to the first surface and the second surface, and the at least one accommodating groove divides the first surface and the second surface into a central region and an edge region;

wherein the application portion comprises a first end and a second end, wherein the first end and the second end are arranged along a length direction of the application portion; the first end is connected to the holding portion, and the second end is positioned away from the holding portion; and a size of the application portion from the first end to the second end is gradually decreased.

2. The makeup brush head according to claim 1, wherein a length and a diameter of each of the bristles are in a range of 0.1-2 mm.

3. The makeup brush head according to claim 2, wherein the length of each of the bristles is in a range of 0.3-0.5 mm.

4. The makeup brush head according to claim 3, wherein the application portion comprises a first surface and a second surface, wherein the first surface and the second surface are positioned opposite to each other, and the bristles are distributed on at least one of the first surface and the second surface.

5. The makeup brush head according to claim 2, wherein the diameter of each of the bristles is 0.2 mm, 0.3 mm, 0.4 mm, 0.5 mm or 0.8 mm.

6. The makeup brush head according to claim 5, wherein the application portion comprises a first surface and a second surface, wherein the first surface and the second surface are positioned opposite to each other, and the bristles are distributed on at least one of the first surface and the second surface.

7. The makeup brush head according to claim 2, wherein the application portion comprises a first surface and a second surface, wherein the first surface and the second surface are positioned opposite to each other, and the bristles are distributed on at least one of the first surface and the second surface.

8. The makeup brush head according to claim 1, wherein the bristles are uniformly distributed on the surface of the application portion.

9. The makeup brush head according to claim 8, wherein the application portion comprises a first surface and a second surface, wherein the first surface and the second surface are positioned opposite to each other, and the bristles are distributed on at least one of the first surface and the second surface.

10. The makeup brush head according to claim 1, wherein the surface of the application portion is divided into an edge region and a central region, and a bristle density of the edge region is greater than a bristle density of the central region.

11. The makeup brush head according to claim 10, wherein the application portion comprises a first surface and a second surface, wherein the first surface and the second surface are positioned opposite to each other, and the bristles are distributed on at least one of the first surface and the second surface.

12. The makeup brush head according to claim 1, wherein the surface of the application portion is divided into an edge region, a central region, and a middle region between the edge region and the central region; a bristle density of the edge region is greater than a bristle density of the middle region, and a bristle density of the central region is identical to the bristle density of the edge region.

13. The makeup brush head according to claim 1, wherein the application portion has an arc-shaped structure, the first surface is a convex surface, the second surface is a concave surface, and the bristles are distributed on the first surface and the second surface.

14. The makeup brush head according to claim 1, wherein the application portion has a conical structure, the first surface and the second surface are arranged symmetrically along a central axis of the makeup brush head, and the bristles are distributed on the first surface and the second surface.

15. The makeup brush head according to claim 1, wherein the application portion has a conical structure, the first surface is a planar surface, and the bristles are distributed on the first surface.

* * * * *